US010087668B2

(12) United States Patent
Wang

(10) Patent No.: US 10,087,668 B2
(45) Date of Patent: Oct. 2, 2018

(54) SUPPORT SYSTEM FOR A WHEEL ASSEMBLY TO BE USED WITH A CLOSURE MEMBER

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 15/846,590

(22) Filed: Dec. 19, 2017

(65) Prior Publication Data

US 2018/0112449 A1 Apr. 26, 2018

(51) Int. Cl.
*A47H 15/00* (2006.01)
*E05D 15/48* (2006.01)
*E05D 15/26* (2006.01)

(52) U.S. Cl.
CPC ..... *E05D 15/48* (2013.01); *A47H 15/00* (2013.01); *E05D 15/26* (2013.01); *E05D 2015/485* (2013.01)

(58) Field of Classification Search
CPC ..... E05D 15/165; E05D 15/26; E05D 15/48; F16C 13/006; A47H 15/00
USPC ..... 16/91, 97, 99, 106, 107, 87 B
See application file for complete search history.

(56) References Cited

U.S. PATENT DOCUMENTS 2,525,143 A * 10/1950 Martin ..... E05D 15/0626 16/89
2,821,738 A * 2/1958 McDonald ..... E05D 15/0652 16/95 R
2,917,771 A * 12/1959 Labrie ..... E05D 15/063 16/105
RE25,246 E * 9/1962 Majeske ..... E05D 15/0634 16/105
3,060,489 A * 10/1962 Blackmer ..... E05D 15/0634 16/94 R
3,193,870 A * 7/1965 McNinch ..... E05D 15/063 16/105
3,277,952 A * 10/1966 Tsuhako ..... E06B 3/481 16/87 R
3,757,384 A * 9/1973 Rusch ..... E05D 15/063 16/223
3,829,929 A * 8/1974 Foltz ..... E05D 15/063 16/223

(Continued)

FOREIGN PATENT DOCUMENTS

WO WO 2010/028715 A1 3/2010

OTHER PUBLICATIONS

Canadian Advanced Exam and Examination Search Report, dated Mar. 28, 2018, issued in corresponding Canadian Patent Application No. 2,989,736. Total 5 pages.

*Primary Examiner* — Roberta S Delisle
(74) *Attorney, Agent, or Firm* — Ostrolenk Faber LLP

(57) ABSTRACT

A support system for use with a door that closes off an opening and a door assembly with the support system. The support system comprises a first support assembly having a main body and a roller assembly connected thereto, the main body comprises a seat for establishing connection with a first position of said door and a connector formed with the seat for connecting with the roller assembly. The connector is displaced from the seat in at least one perspective such that the roller assembly connected thereto is staggered relative to the seat in that perspective.

14 Claims, 6 Drawing Sheets

(56) References Cited

U.S. PATENT DOCUMENTS

| | | | | |
|---|---|---|---|---|
| 6,983,512 | B2 * | 1/2006 | De Oliveira | E05D 15/063 16/87 R |
| 8,046,872 | B2 * | 11/2011 | Burgess, III | E05D 15/0639 16/103 |
| 8,984,716 | B2 * | 3/2015 | Proctor | E05D 15/063 16/97 |
| 2002/0162190 | A1 | 11/2002 | Spork | 16/91 |
| 2008/0092450 | A1 * | 4/2008 | Balduck | E05D 15/0652 49/404 |

* cited by examiner

SUPPORT SYSTEM FOR A WHEEL ASSEMBLY TO BE USED WITH A CLOSURE MEMBER

The present invention relates to a support system for a wheel assembly to be used with a closure, for example particularly, but not exclusively, a sliding door or a folding door.

BACKGROUND OF THE INVENTION

Generally, the support system for a folding or sliding door is either top hung or bottom rolling. Durability has always been an issue. For top hung doors, sagging under the weight of the door is a common problem. This is partly due to the deterioration of parts in the support system and more often the aging of the fastening between the support system and the door body. With a bottom rolling support system, the wheels are more susceptible to deformation, dependent on their load bearing capacity.

Furthermore, a common problem with both types of support system is the number of different parts involved and the different shape and configurations of the main parts. The making of these parts require different molds which adds to the overall costs in making and building the support system. The complexity would likely to contribute to the wear and tear.

The invention seeks to eliminate or at least to mitigate such shortcomings by providing novel support structure for use with a closure member.

SUMMARY OF THE INVENTION

In a first aspect of the invention there is provided a support system for use with a door that closes off an opening comprising a first support assembly having a main body and a roller assembly connected thereto; the main body comprises a seat for establishing connection with a first position of said door and a connector formed with the seat for connecting with the roller assembly; wherein the connector is displaced from the seat in at least one perspective such that the roller assembly connected thereto is staggered relative to the seat in that perspective; preferably, the support system further comprising a second support assembly having a main body being identical in construction to that of the first support assembly such that the main bodies of the first and second support assembly are interchangeable; more preferably, the connector in the first support assembly is pivotally connected to a shaft to which the roller is rotatably affixed, such that the seat is pivotable relative to the roller about an pivotal axis that is displaced from the seat in the at least one perspective; yet more preferably, the roller assembly includes two rollers rotatable about transversely arranged rotational axis; advantageously, the roller assembly includes at least one roller and the first support assembly further includes a track defining a pathway that guides movement of the roller of the first support assembly, which is situated therein; more advantageously, the first support assembly further includes a track defining two pathways that guide movement of respective rollers situated therein; yet more advantageously, the second support assembly includes a roller assembly connected to the main body through the connector that is displaced from the main body in at least one perspective such that the roller assembly connected thereto is staggered relative to the seat in that perspective; preferably, the connector of the second support assembly is pivotally connected to a shaft to which the roller is rotatably affixed, such that the seat is pivotable relative to the roller about a pivotal axis displaced from the seat in the at least one perspective; yet more preferably, the roller is rotatable about a rotational axis which extends traversely to the pivotal axis; more preferably, the seat of the first support assembly is pivotable relative to the roller about a pivotal axis which is aligned with that of the second support assembly when these assemblies are assembled to said door thereby functioning as a pair that pivots about a same pivotal axis; it is preferable that the second support assembly further includes a track defining a pathway that guide movement of the roller of the second support assembly, which is situated therein; it is advantageously that the seat includes two portions defining an arcuate angle therebetween for establishing connection with respective surfaces on said door; preferably, the main body of the second support assembly comprises a seat that has two portions defining an arcuate angle therebetween for establishing connection with respective surfaces on said door; more preferably, the arcuate angle is a right angle.

In a second aspect of the invention there is provided a door assembly comprising two or more door panels interconnected by a hinge joint thereby permitting pivotal movement between door panels, wherein at least one of the door panels is provided with the support system as claimed in any one of claims 1 to 12 such that the at least one of the door panels includes roller for sliding along a predetermined pathway; preferably, the hinge joint is pivotal about a first pivotal axis and the support system includes a second pivotal axis about which the door panel pivots relative to the roller; more preferably, the first and second pivotal axis are provided on a same imaginary plane.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
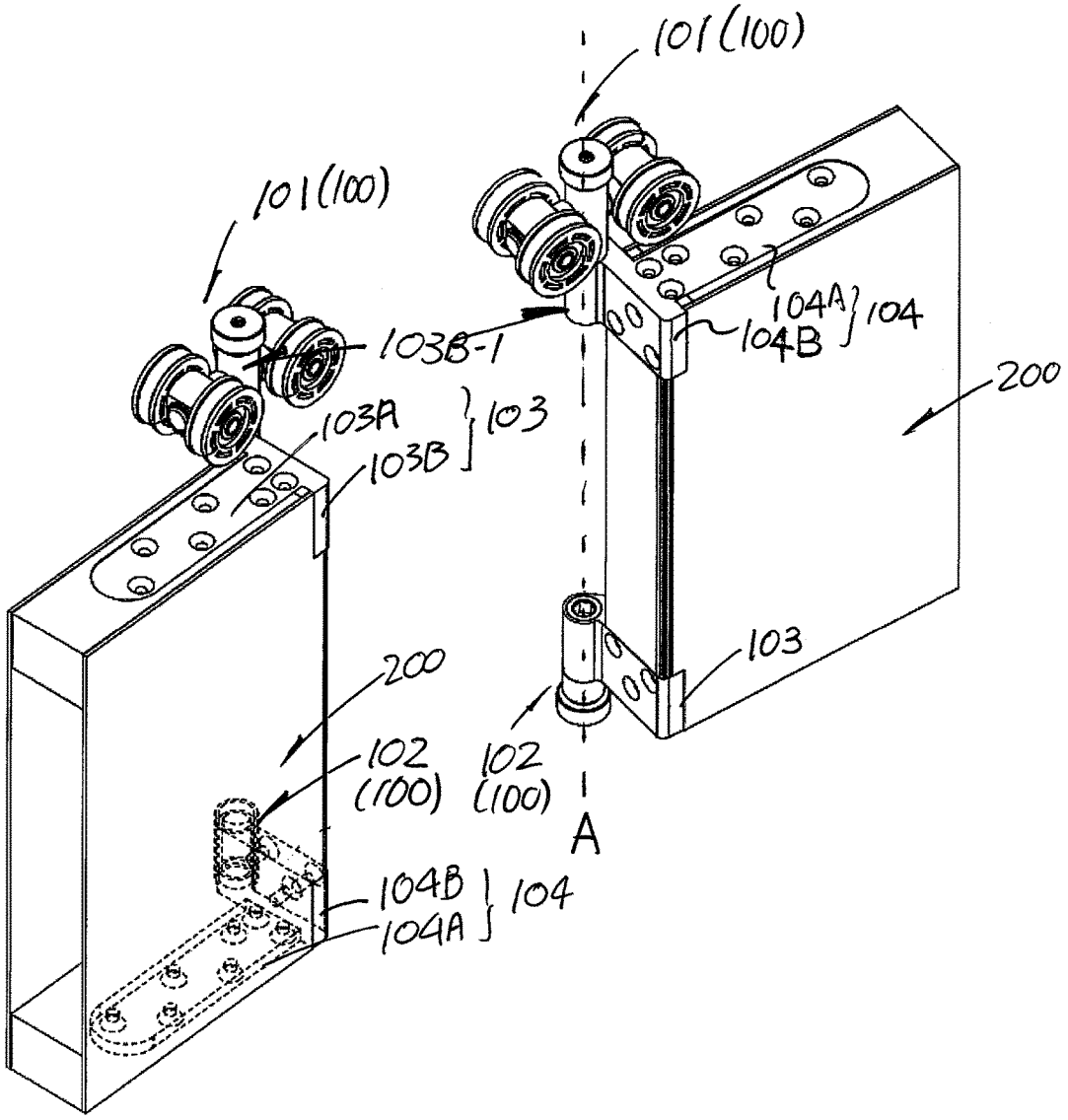
FIG. 1 is a perspective view of two closure members being provided with respective support systems of the invention at different positions thereon.

Referring to FIG. 1 there is provided an embodiment of a support system 100 according to the invention. The support system 100 includes an upper support assembly 101 and a lower support assembly 102 functioning as a pair to support a closure member such as a door/door assembly 200 in an opening.

The upper and lower assemblies 101 and 102 has duel functions in addition to providing support for the door 200 in the door frame or wall. It allows the door 200 to displace in a linear direction and to pivot about a main axis A common to the upper and lower assemblies 101 and 102.

More specifically, they allow the door 200 to slide linearly and function as hinges that allow the door 200 to open and close angularly.

Generally, the door 200 includes more than one door parts and each door parts being foldable upon one another. The door panels are joined by customary upper and lower hinges. These upper and lower hinges are arranged to share a common pivotal axis which is at the rear or in the front of the door 200 depending on the intended direction of folding.

The main axis A is on a same imaginary plane as the pivotal axis of the customary hinges that runs generally parallel to the unfold door 200. The imaginary plane is either at the rear or in front of the door 200 depending on the intended direction of folding. This creates a clean finish on the side where the hinges are not shown.

Each of the upper and lower support assembly 101 and 102 includes a seat or cap 103 and 104 that connects the respective upper and lower support assembly 101 and 102 to the upper and lower rails as well as a same stile of the door 200. The cap 103 or 104 has a pair of connection plates 103A and 103B, 104A and 104B. The connection plates 103A and 103B; 104A and 104B extend transversely with respect to one another to rest against two transversely arranged outer surfaces of the rail and stile on the door 200. More specifically, an arcuate angle is defined between the pair of connection plates 103A and 103B; 104A and 104B, which is dependent upon the angle defined between the surfaces of the door 200 and preferably a right angle.

In the specific embodiment of the support member 100, the cap 103 or 104 is a one-piece structure with the pair of connection plates 103A and 103B, 104A and 104B integrally formed such that the cap 103 or 104 is an L-shaped integral piece. This adds to the overall mechanical strength of the respective upper and lower support assemblies 101 and 102.

Figure 2:
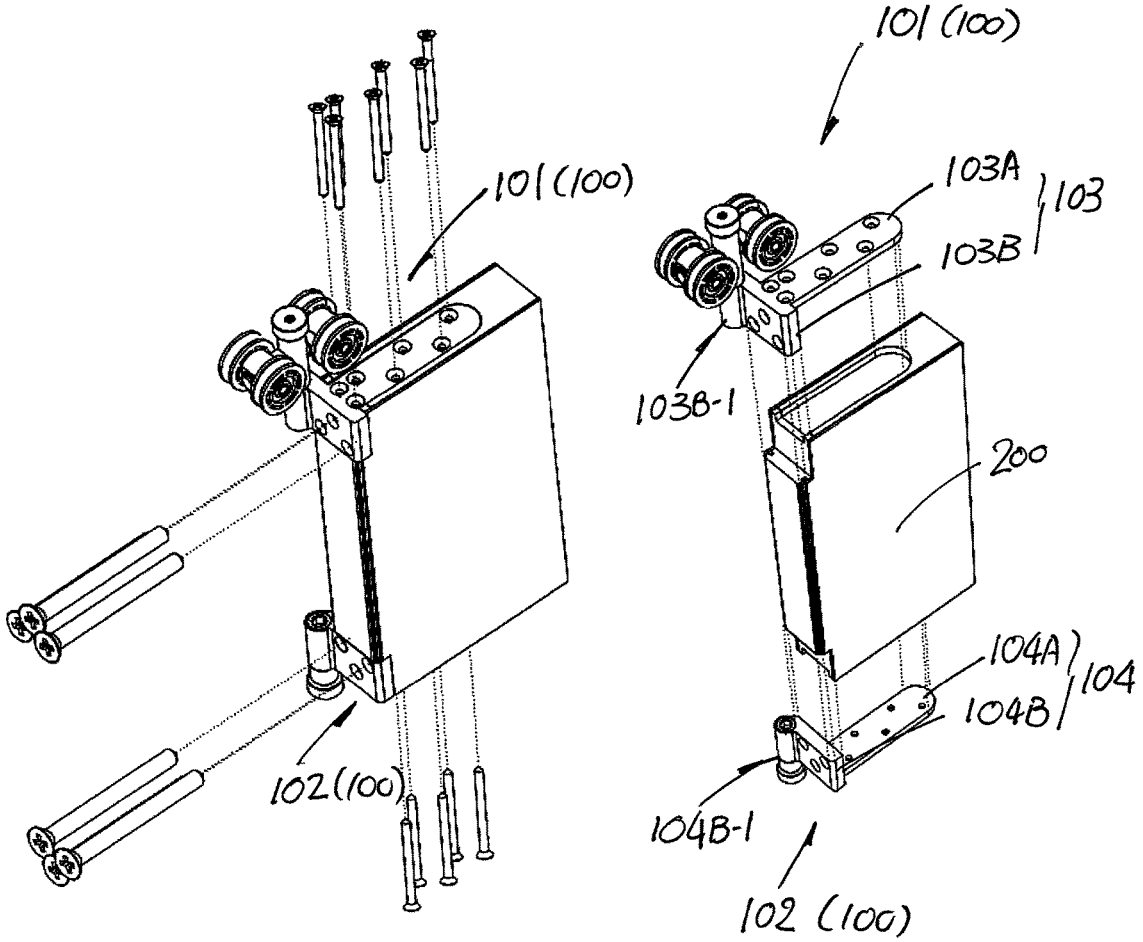
FIG. 2 is an illustrative drawing showing a way of assembling the support system onto the closure member in FIG. 1.
Figure 3:
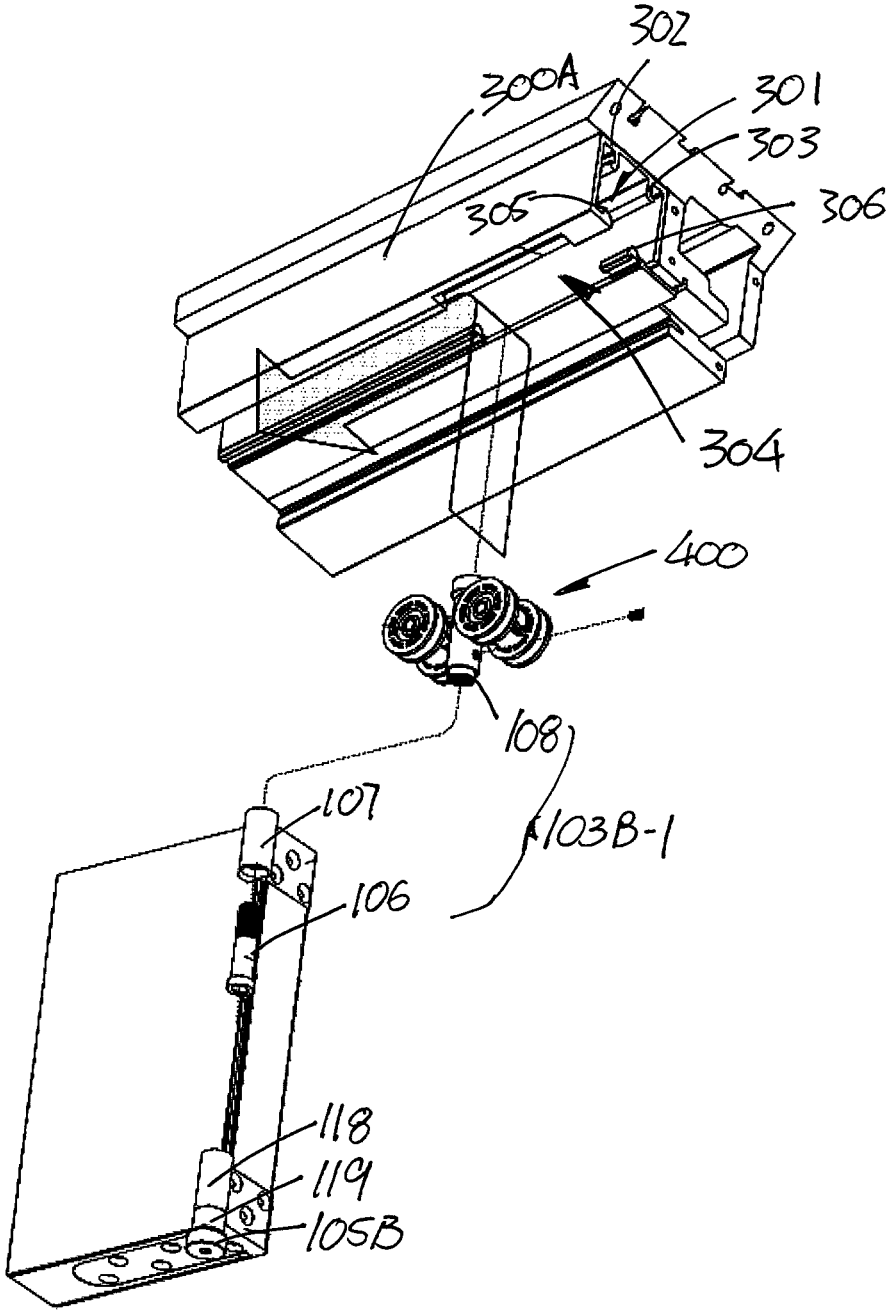
FIG. 3 is an illustrative drawing showing an alternative way of assembling the support system onto the closure member in FIG. 1.

On each connection plate 103A, 103B, 104A and 104B there an array of screw holes through which the screw holds and secures the respective upper and lower support assembly 101 and 102 to the door 200. As shown in FIG. 2, inlay recesses are formed on the rails and a stile of the door 200 that mirror the shape of the connection plates 103A, 103B, 104A and 104B to accommodate them such that when the support assemblies 101 and 102 are inlaid, the upper surfaces of the connection plates 103A and 103B, 104A and 104B flush with the door 200 surface to form a clean and tidy finishing as shown in FIG. 2.

Connector posts 103B-1 and 104B-1 are provided on a side of the respective connection plates 103B and 104B and is displaced from the connection plates 103B and 104B in at least one perspective e.g. when viewed from the top of the support system. The connection plates 103B and 104B are rectangular pieces with respective connector posts 103B-1 and 104B-1 on same left or right side. The connector posts 103B-1 and 104B-1 share the same main axis A.

The connector post 103B-1 includes a guiding roller 105A on its upper end and the connector post 104B-1 includes a guiding roller 105B at its lower end. The connector post 103B-1 is longer than the connector post 104B-1 as it accommodates and connects four rollers 110 in two-pair arrangement to the upper support assembly 101.

Figure 4:
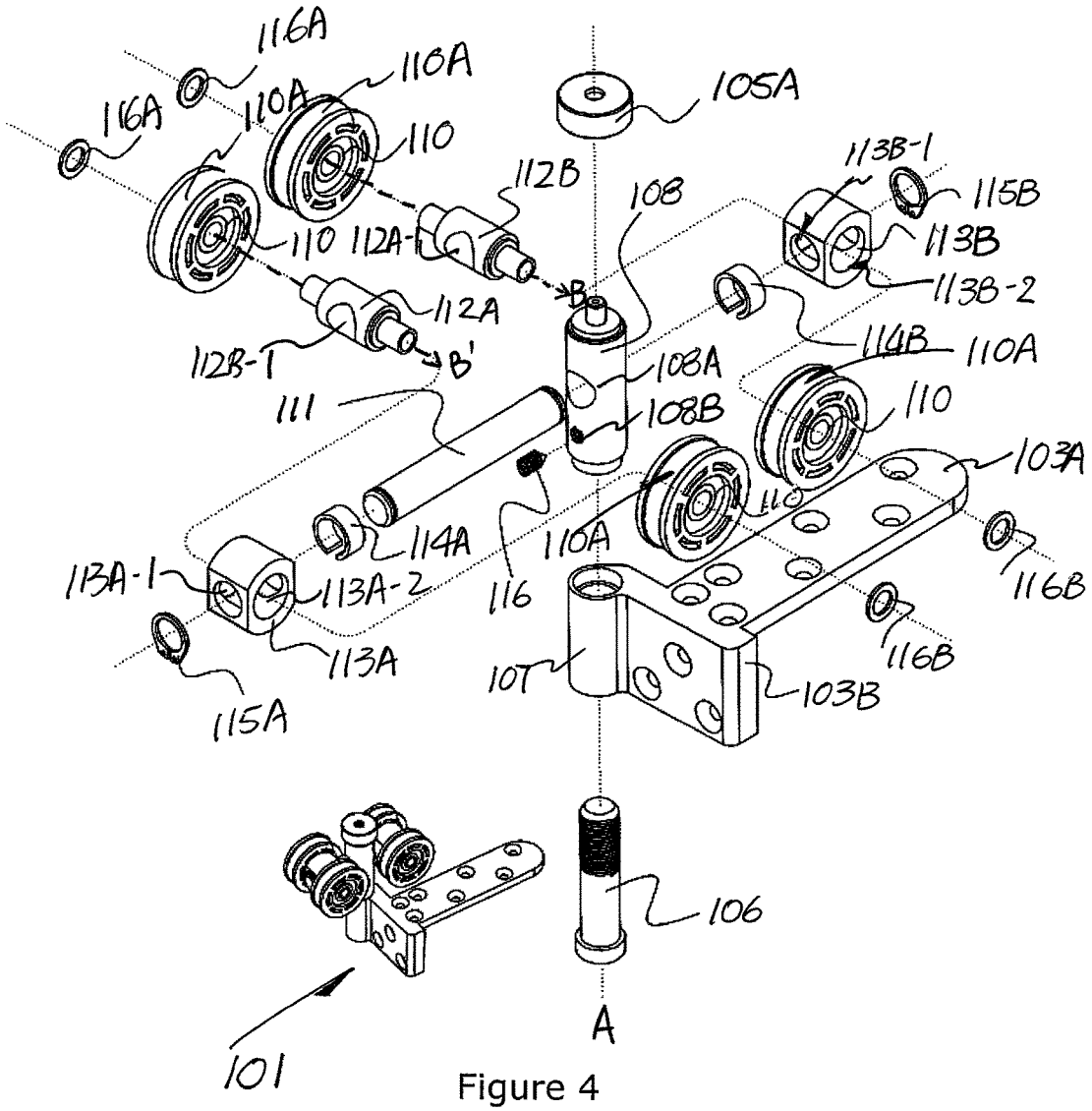
FIG. 4 is an exploded view of a part of the support system in FIG. 1.

Referring to FIG. 4 which shows an exploded view of the upper support assembly 101, the connector post 103B-1 includes a cylinder 107 fused to the connection plate 103B and a first connector 106 in the form of a blot that runs through the cylinder 107 to connect and align with a main shaft 108. A set screw 116 is screwed into a threaded bore 108B to maintain relative position between the main shaft 108 and the cylinder 107. The guiding roller 105A is connected to an upper end of the main shaft 108 and to rotate thereabout. The four rollers 110 are connected to the main shaft 108 through a bridge 111 and two roller shafts 112A and 112B. On the main shaft 108 there is a bore 108A that runs transverse to the main axis A. On the two roller shafts 112A and 112B, there are respective bores 112A-1 and 112B-1 that runs transverse to a longitudinal axis B and B' of the roller shafts 112A and 112B. Two mounting blocks 113A and 113B are mounted on respective shafts 112A and 112B. The mounting blocks 113A and 113B each has two bores 113A-1, 113A-2, 113B-1, 113B-2 crossing one another perpendicularly. These two mounting blocks 113A and 113B are mounted over the roller shafts 112A and 112B through respective bores 113A-2 and 113B-2 and the bores 113A-1 and 113B-1 on the mounting blocks 113A and 113B are aligned with the bores 112A-1 and 112B-1 on the roller shafts 112A and 112B. The bridge 111 connects the roller shafts 112A and 112B to the main shaft 108 through spacers 114A and 114B and the bores 112A-1, 112B-1, 113Aδ-1 113B-1 and 108A. The mounting blocks 113A and 113B are maintained in position by respective C-clips/spring clips 115A and 115B. The rollers 110 are assembled to the opposite sends of the roller shafts 112A and 112B and are maintained in position by respective C-clips/spring clips 116A and 116B. These rollers 110 are rotatable about the respective roller shafts 112A and 112B.

Figure 5:
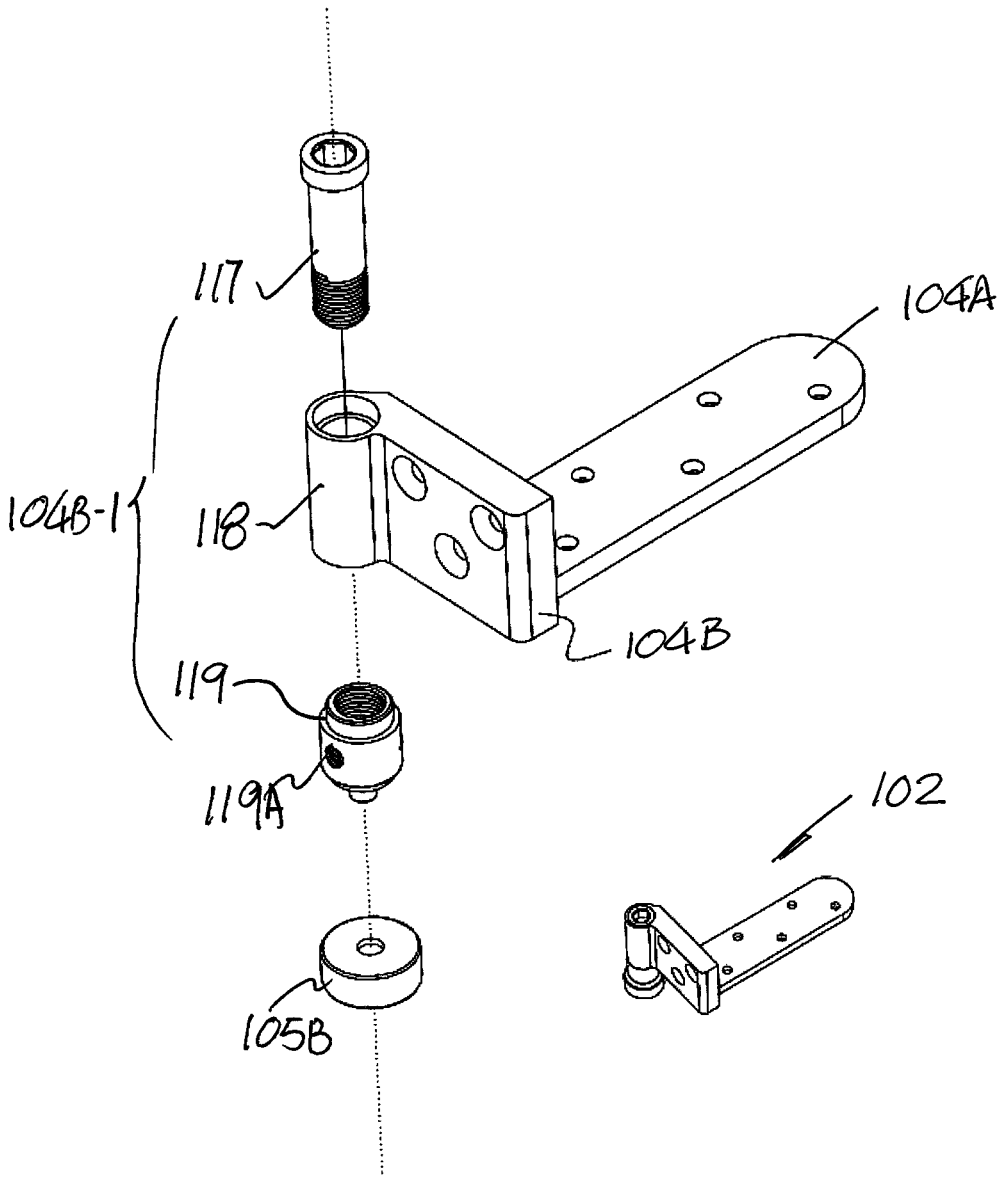
FIG. 5 is an exploded view of another part of the support system in FIG. 1.

FIG. 5 shows an exploded view of the lower support assembly 102 in which the connector post 104B-1 includes a first connector in the form of a bolt 117, a cylinder 118, a shaft 119 and the guiding roller 105B. The blot 117 runs through the cylinder 118 which fuses with the connection plate 104B to connect with the shaft 119 on which the guiding roller 105B is rotatably connected. A set screw may be inserted into a bore 119A in the shaft 119.

In both the upper and lower support assemblies 101 and 102, the cylinder 107 or 118 is rotatable about the axis A with an inner periphery of the cylinder 107 or 118 sliding over a part of an outer periphery of the respective bolts 106 and 117, which is smooth i.e. without threads. The connector posts 103B-1 and 104B-1 are aligned on axis A but off set from the connection plates 103A, 103B, 104A and 104B and are situated at a corner of the upper and lower support assemblies 101 and 102.

In summary, the seat/cap 103 and the cylinder 107 of the upper support assembly 101 defines a main body which is identical to a main body of the lower support assembly 102 that comprises the cap 104 and cylinder 118. The main body is preferably made of stainless steel.

The main bodies are interchangeable. As shown in FIG. 1, the cap 103 may be provided as part of the main body of the upper support assembly 101 (drawing on the right) or as part of the main body of the lower support assembly 102 (drawing on the left).

Figure 6:
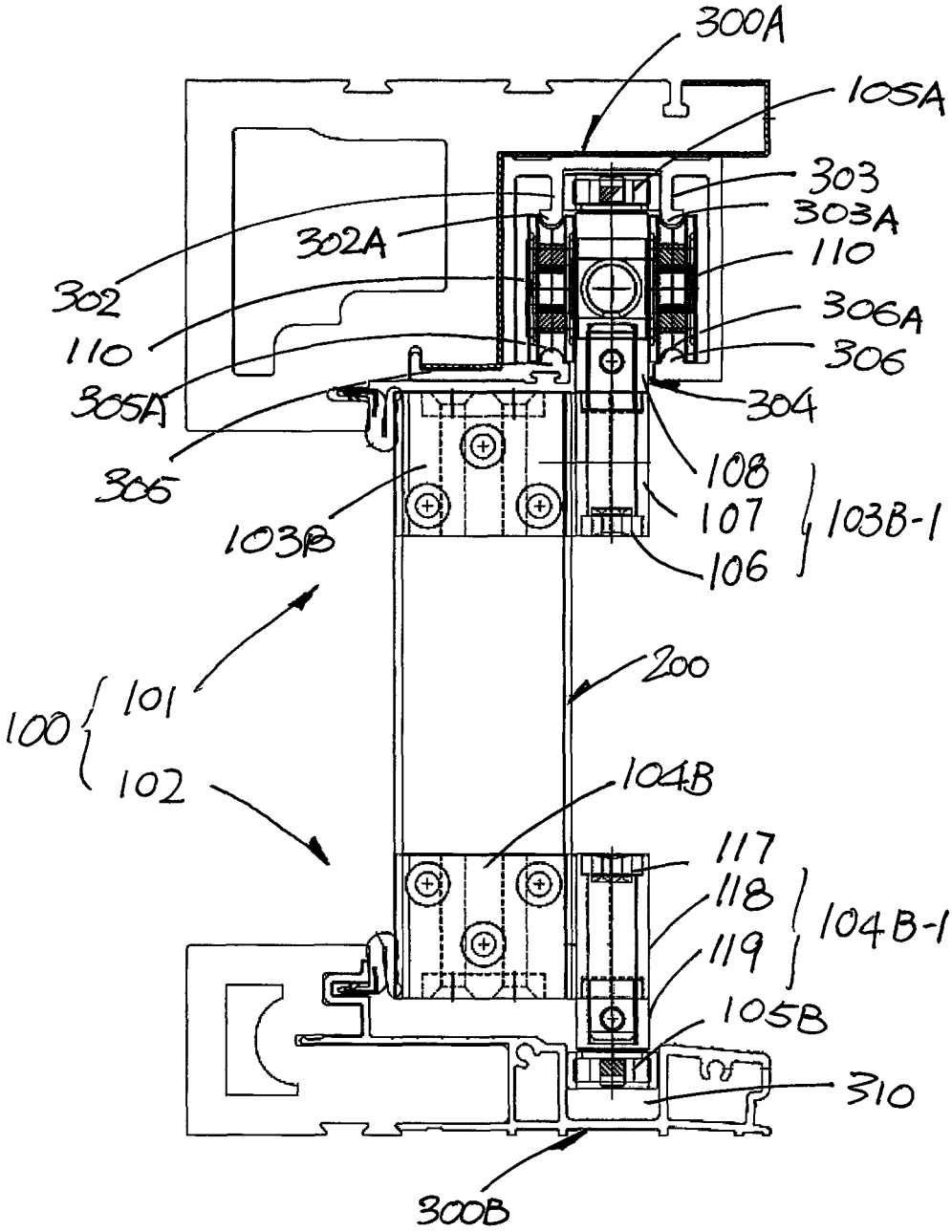
FIG. 6 is a cross sectional view showing the support system in use with wheels in respective tracks.

Tracks 300A and 300B are provided with the upper and lower support assemblies 101 and 102 for guiding movement of the rollers 110 and guiding rollers 105A and 105B on support assemblies 101 and 102 in a predefined pathway. An upper track 300A is securely fixed to an upper part of a frame of the door 200 or to an upper wall on to which the door 200 is to be assembled. Referring to FIG. 6, the upper track 300A defines an elongated space 301 in which the guiding roller 105A and the rollers 110 are to be accommodated. The space 301 has a square cross-sectional shape when taken along length. Two projections 302 and 303 extend from a top wall of the track 300A and preferably along length of the track 300A. The projections 302 and 303 each has an expanded rounded end 302A and 303A which is shaped to be accommodated in a circumferential grooves 110A on the respective rollers 110. The projections 302 and 303 are spaced apart thereby defining an elongated passageway for accommodating the guiding roller 105A. On a bottom wall of the track 300A there is defined an opening 304 to allow for the main shaft 108. There are protrusions 305 and 306 extending from the bottom wall of and along length of the track 300A. The protrusions 305 and 306 have rounded free ends 305A and 306A shaped for complementary accommodation in the grooves 110A of the respective rollers 110. The projections 302 and 303 and the protrusions 305 and 306 are aligned to form two pairs of guides that guide the direction of movement of upper support assembly 101. The projection 302 or 303 and the protrusions 305 or 306 functions as a pair of jaw for maintaining the rollers 110 in a preferred position in the space 301.

The lower track 300B is securely fixed to a lower part of the frame of the door 200 or to a bottom wall on to which the door 200 is to be assembled. The lower track 300B includes an elongated void 310 shaped and sized to accommodate the guiding roller 105B. Inner walls of the void 310 defines a shaped path for the guiding roller 105B thereby guides the direction of movement of the lower support assembly 102. A paddle is provided on an outer side of the inner wall of the void 310 and is integrally formed thereto.

When assembling the support system 100, the rollers 105A and rollers 110 of the upper support assembly 101 are rotatably affixed to the respective roller shafts 112A and 112B, the bridge 111 and the main shaft 108 to form the upper roller assembly 400. Instead of being connected to the main body of the upper support assembly 101, it is inserted into the space 301 of the upper track 300A with the grooves on the rollers 110A matching the expanded rounded ends 302A and 303A of the respective projections 302 and 303 and the rounded ends 305A and 306A of the respective protrusions 305 and 306. The roller 105A is inserted between the projections 302 and 303. Thereafter, the main shaft 108 is connected to the cylinder 107 by the connector 106.

As for the lower support assembly 102, the guiding roller 105B is rotatably affixed to the cylinder 110 through the connectors 117 and the shaft 119 before the roller 105B is inserted into the lower track 300B.

The seats 103A, 103B, 104A and 104B of the upper and lower support assemblies 101 and 102 are affixed to adjacent surfaces of the door 200 by way of screws. As connection is enhanced by way of screw connections on two adjacent surfaces of the door 200, dislodgment of the support system 100 would be less likely.

The invention has been given by way of example only, and various other modifications of and/or alterations to the described embodiment may be made by persons skilled in the art without departing from the scope of the invention as specified in the appended claims.

The invention claimed is:

1. A support system for use with a door that closes off an opening, the support system comprising:

a first support assembly comprising a main body;

a roller assembly connected to the main body;

a track defining two pathways that guide movement of respective rollers situated therein;

the main body comprises a seat for establishing connection with a first position of said door and a connector formed with the seat for connecting with the roller assembly;

wherein the connector is displaced from the seat in at least one perspective such that the roller assembly connected thereto is staggered relative to the seat in that perspective, and wherein the connector is pivotally connected to a shaft to which the roller is rotatably affixed, such that the seat is pivotable relative to the roller about a pivotal axis that is displaced from the seat in the at least one perspective.

2. The support system as claimed in claim 1, further comprising a second support assembly comprising a second main body identical in construction to the main body of the first support assembly such that the second main body is interchangeable with the main body.

3. The support system as claimed in claim 2, wherein the second support assembly includes a roller assembly connected to the main body through the connector that is displaced from the main body in at least one perspective such that the roller assembly connected thereto is staggered relative to the seat in that perspective.

4. The support system as claimed in claim 3, wherein the connector of the second support assembly is pivotally connected to a shaft to which the roller is rotatably affixed, such that the seat is pivotable relative to the roller about a pivotal axis displaced from the seat in the at least one perspective.

5. The support system as claimed in claim 4, wherein the roller is rotatable about a rotational axis which extends traversely to the pivotal axis.

6. The support system as claimed in claim 4, wherein the seat of the first support assembly is pivotable relative to the roller about a pivotal axis which is aligned with that of the second support assembly when these assemblies are assembled to said door thereby functioning as a pair that pivots about a same pivotal axis.

7. The support system as claimed in claimed in claim 3, wherein the second support assembly further includes a track defining a pathway that guide movement of the roller of the second support assembly, which is situated therein.

8. The support system as claimed in claim 2, wherein the main body of the second support assembly comprises a seat that has two portions defining an arcuate angle therebetween for establishing connection with respective surfaces on said door.

9. The support system as claimed in claim 1, wherein the roller assembly includes two rollers rotatable about transversely arranged rotational axis.

10. The support system as claimed in claim 1, wherein the seat includes two portions defining an arcuate angle therebetween for establishing connection with respective surfaces on said door.

11. The support system as claimed in claim 10, wherein the arcuate angle is a right angle.

12. A door assembly comprising two or more door panels interconnected by a hinge joint thereby permitting pivotal movement between door panels, wherein at least one of the door panels is provided with the support system as claimed in claim 1 such that the at least one of the door panels includes roller for sliding along a predetermined pathway.

13. The door assembly as claimed in claim 12, wherein the hinge joint is pivotal about a first pivotal axis and the support system includes a second pivotal axis about which the door panel pivots relative to the roller.

14. The door assembly as claimed in claim 13, wherein the first and second pivotal axis are provided on a same imaginary plane.

* * * * *